US009341381B2

(12) United States Patent
Braden et al.

(10) Patent No.: US 9,341,381 B2
(45) Date of Patent: May 17, 2016

(54) HOME APPLIANCE WITH SUPPLEMENTAL PRIMARY AIR SUPPLY

(71) Applicant: BSH Home Appliances Corporation, Irvine, CA (US)

(72) Inventors: Ben Braden, Lafollette, TN (US); Jeremiah Nash, Knox, TN (US); Timothy Russell, Jacksboro, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 170 days.

(21) Appl. No.: 13/711,711

(22) Filed: Dec. 12, 2012

(65) Prior Publication Data

US 2014/0158110 A1 Jun. 12, 2014

(51) Int. Cl.

| | |
|---|---|
| ***F24C 3/08*** | (2006.01) |
| ***F24C 15/00*** | (2006.01) |
| ***F23L 5/02*** | (2006.01) |
| ***F23D 14/10*** | (2006.01) |
| ***F23D 14/34*** | (2006.01) |
| ***F23D 14/64*** | (2006.01) |

(52) U.S. Cl.

CPC ..... *F24C 15/006* (2013.01); *F23D 14/105* (2013.01); *F23D 14/34* (2013.01); *F23D 14/64* (2013.01); *F23L 5/02* (2013.01); *F24C 3/087* (2013.01); *F23N 2033/06* (2013.01); *F23N 2041/08* (2013.01)

(58) Field of Classification Search

CPC ..... F24C 15/322; F24C 15/006
USPC ..... 126/39 E, 21 A
See application file for complete search history.

(56) References Cited

U.S. PATENT DOCUMENTS

| | | | | | |
|---|---|---|---|---|---|
| RE29,602 | E * | 4/1978 | Perl | 126/21 A |
| 4,108,139 | A * | 8/1978 | Gilliom et al. | 126/21 A |
| 4,240,397 | A * | 12/1980 | Seidel | 126/21 R |
| 4,431,889 | A * | 2/1984 | Saponara et al. | 219/683 |
| 5,410,949 | A * | 5/1995 | Yung | 99/348 |
| 6,723,970 | B1 * | 4/2004 | Whipple, Jr. | 219/681 |
| 6,772,752 | B1 * | 8/2004 | Boyer | 126/21 A |
| 6,972,398 | B2 * | 12/2005 | Kang | 219/757 |
| 7,323,662 | B2 * | 1/2008 | Cho et al. | 219/401 |
| 7,708,008 | B2 * | 5/2010 | Elkasevic et al. | 126/198 |
| 7,766,005 | B2 | 8/2010 | Lee et al. | |
| 7,836,877 | B2 * | 11/2010 | Gagas et al. | 126/299 D |

(Continued)

FOREIGN PATENT DOCUMENTS

EP 2072901 A1 6/2009

*Primary Examiner* — Gregory Huson
*Assistant Examiner* — Aaron Heyamoto
(74) *Attorney, Agent, or Firm* — James E. Howard; Andre Pallapies

(57) ABSTRACT

A home appliance, particularly a gas range including an appliance body, a cooktop on the appliance body, an oven cavity in the body, a gas-operable heating element in the cavity for heating the cavity to a cooking temperature and including a gas mixing pipe having an inlet open to the cavity for intake of gas and air for combustion. A ventilation channel extends through the appliance body intermediate the cooktop and the oven cavity. A fan is in the appliance body, the fan being in fluid communication with the ventilation channel for creating an airstream within the ventilation channel. An air conduit extends between the ventilation channel and the gas mixing pipe, with an air conduit inlet in the airstream and an air conduit outlet adjacent the gas mixing pipe to direct air from the airstream to the gas mixing pipe for combustion with the gas and air.

19 Claims, 5 Drawing Sheets

(56) References Cited

U.S. PATENT DOCUMENTS

| | | | | |
|---|---|---|---|---|
| 7,856,973 | B2 * | 12/2010 | Kim et al. | 126/273 R |
| 7,878,189 | B2 * | 2/2011 | Lee et al. | 126/299 D |
| 2005/0056267 | A1 * | 3/2005 | Levi et al. | 126/21 R |
| 2007/0277799 | A1 * | 12/2007 | Claesson et al. | 126/21 A |
| 2011/0076786 | A1 * | 3/2011 | Ahmad et al. | 438/5 |
| 2011/0214660 | A1 * | 9/2011 | Gillespie et al. | 126/21 A |
| 2011/0275023 | A1 * | 11/2011 | Knight | 432/1 |
| 2012/0037142 | A1 * | 2/2012 | Chilton et al. | 126/21 R |
| 2012/0152223 | A1 * | 6/2012 | Sillmen et al. | 126/21 A |

* cited by examiner

HOME APPLIANCE WITH SUPPLEMENTAL PRIMARY AIR SUPPLY

BACKGROUND OF THE INVENTION

The present invention relates broadly to home appliances for cooking and, more particularly, to a gas range having a supplemental primary air supply.

Gas ranges provide an excellent baking and broiling environment for preparing various dishes in a highly effective manner. Gas ovens burn hot and steady and provide excellent temperature control as well as an instant on-and-off operation with little residual heat. For oven heating, gas ovens include bake elements and broil elements similar to their electric counterparts, but with different structures based on the need to supply the gas heating elements with a combustible fuel and air mixture and the ability to produce discrete flames for even oven-cavity heating.

Gas broiler elements are used when the oven is to be taken to an elevated temperature for broil-type cooking and due to the location of the broil element near the top of the oven cavity, the space between the oven cavity and an associated cooktop can reach undesirable temperatures. Therefore, in order to provide better control of the cooktop temperature as well as protect the electronics of nearby control systems, gas ovens can include a ventilation channel that can provide a cooling airstream intermediate the oven cavity and the cooktop. Usually such a ventilation channel includes a fan for forced-air ventilation of the channel intermediate the cooktop and the oven cavity.

The gas burner is fueled by a mixture of gas injected by a gas nozzle and ambient air from behind the oven cavity. The air-to-gas ratio is controlled generally to provide the most efficient burning situation while providing the necessary energy input to elevate the oven to cooking temperatures, or in the case of pyrolytic cleaning, to cleaning temperatures.

During times of elevated temperatures within the oven cavity and when the fan is in operation, the fan intake tends to draw primary air away from the broil burner intake and the burning efficiency of the broil burner is reduced due to air deficiency. It therefore becomes desirable to enhance the efficiency of the gas broil burner by providing more primary air to the broil burner intake during such periods of air deficiency.

SUMMARY OF THE INVENTION

It is accordingly an object of the present invention to provide a gas oven with enhanced broil burner efficiency without adding undue expense to the overall cost and production complexity of the gas range.

It is another object of the present invention to provide such a gas range with supplemental primary air for enhanced burning efficiency during high-temperature operations.

It is another object of the present invention to provide such a gas range with enhanced burning efficiency in an economic manner that utilizes existing structure where available.

To those ends, a home appliance with a supplemental primary air supply includes an appliance body, a cooktop on the appliance body and an oven cavity within the appliance body. A gas-operable heating element is within the oven cavity for heating the oven cavity to a predetermined cooking temperature, with the heating element including a gas mixing pipe having an inlet open to the oven cavity for intake of gas and primary air for combustion.

A ventilation channel extends through the appliance body intermediate the cooktop and the oven cavity. A fan is located within the appliance body, with the fan being in fluid communication with the ventilation channel for creating an airstream within the ventilation channel.

An air conduit extends between the ventilation channel and the gas mixing pipe, with the air conduit having an air conduit inlet in the airstream and an air conduit outlet closely adjacent the gas mixing pipe to direct air from the airstream to the gas mixing pipe for combustion with the gas and primary air.

Preferably, the fan is mounted within a fan housing having an air outlet into the ventilation channel and the air conduit is mounted with the air conduit inlet in the air outlet of the fan housing. It is preferred that the air conduit is formed as a tubular member having an air channel extending between the air conduit inlet and the air conduit outlet for free air passage through the air conduit. The air conduit inlet preferably includes a flared end portion, and the air channel preferably has a generally circular cross-section and a substantially constant diameter throughout its length. It is preferred that the air conduit outlet is mounted adjacent a gas supply nozzle at the inlet of the gas mixing pipe.

Preferentially, the fan is configured to activate at a predetermined temperature to provide air to the ventilation channel and the air conduit, wherein the fan is configured to activate at a temperature in the range of about 300° F. to about 350° F.

It is further preferred that the fan includes an inlet for drawing air from outside the appliance for forced delivery of air from outside the appliance to the ventilation channel and the air conduit.

The present invention is more particularly embodied in a range having a supplemental primary air supply. To that end, the present range includes a range body, a cooktop on the range body, an oven cavity within the range body and a gas-operable heating element within the oven cavity for heating the oven cavity to a predetermined cooking temperature, wherein the heating element includes a gas mixing pipe having an inlet open to the oven cavity for intake of gas and primary air for combustion.

A ventilation channel extending through the range body intermediate the cooktop and the oven cavity. A fan is located within the range body, the fan being in fluid communication with the ventilation channel for creating an airstream within the ventilation channel.

An air conduit extends between the ventilation channel and the gas mixing pipe, the air conduit having an air conduit inlet in the airstream and an air conduit outlet closely adjacent the gas mixing pipe to direct air from the airstream to the gas mixing pipe as supplemental primary air for combustion with the gas and primary air.

Preferably, the fan is mounted within a fan housing having an air outlet into the ventilation channel and the air conduit is mounted with the air conduit inlet in the air outlet of the fan housing. It is further preferred that the air conduit is formed as a tubular member having an air channel extending between the air conduit inlet and the air conduit outlet for free air passage through the air conduit. Preferably, the air conduit inlet includes a flared end portion. It is preferred that the air channel has a generally circular cross-section and a substantially constant diameter throughout its length and that the air conduit outlet is mounted adjacent a gas supply nozzle at the inlet of the gas mixing pipe.

Preferentially, the fan is configured to activate at a predetermined temperature to provide air to the ventilation channel and the air conduit, and, more particularly, the fan is configured to activate at a temperature in the range of about 300° F. to about 350° F.

It is further preferred that the fan includes an inlet for drawing air from outside the range for forced delivery of air to the ventilation channel and the air conduit.

DESCRIPTION OF THE PREFERRED EMBODIMENT

Figure 1:
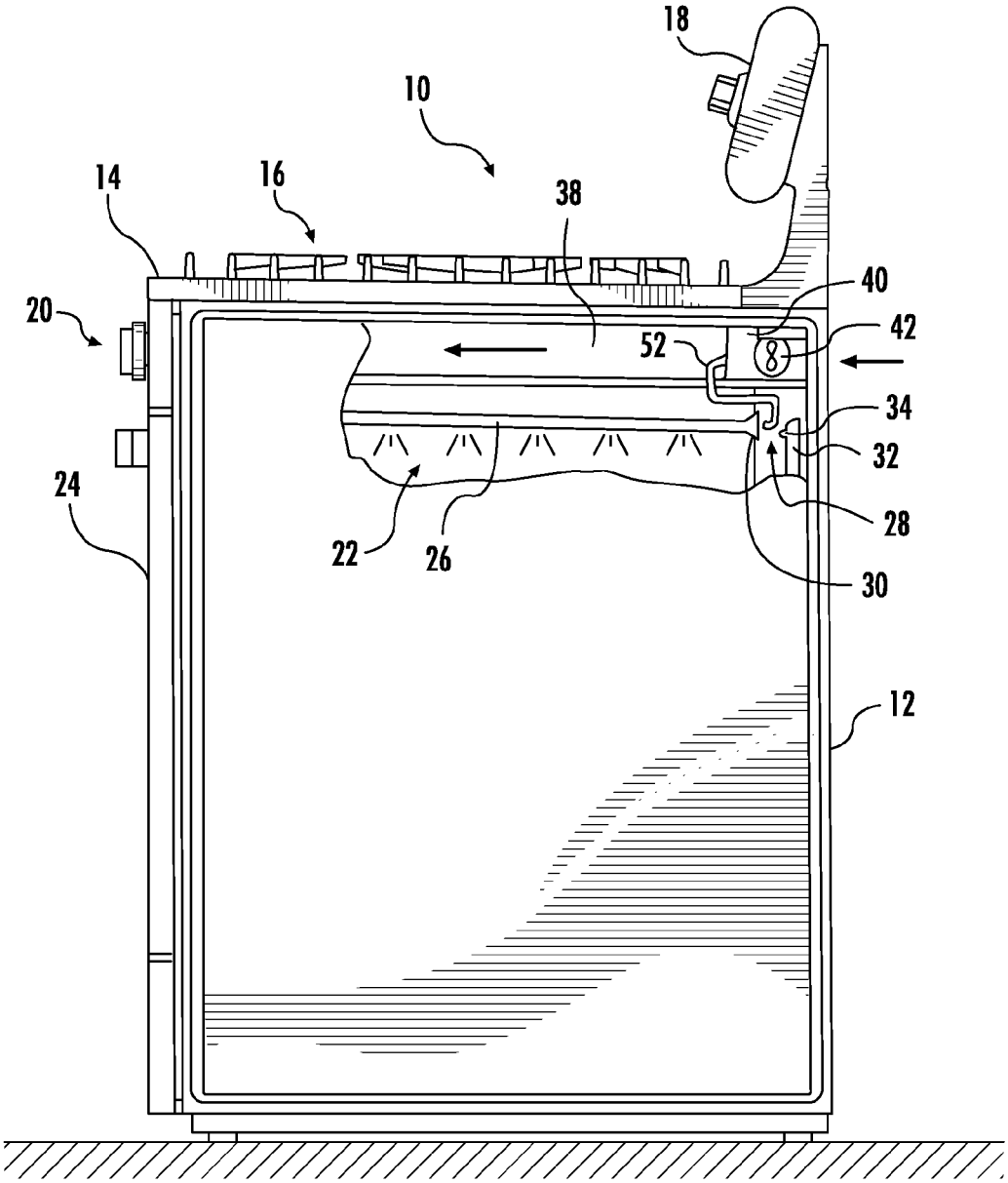
FIG. 1 is a side diagrammatic view of a gas range broken open to illustrate the broil burner with an air conduit according to one preferred embodiment of the present invention.

Turning now to the drawings and, more particularly to FIG. 1, a range having a supplemental primary air supply for a broil element, according to the preferred embodiment of the present invention, is illustrated generally at 10 and includes a generally rectangular floor standing body 12 that includes an internal framework covered by external body panels. A cooktop 14 is located on the top portion of the body 12 and includes a number of burners having grates 16 for supporting cooking vessels.

An upper control panel 18 is mounted behind and above the cooktop 14 for general disposition against a kitchen wall. The upper control panel 18 may include oven controls and a timer. A front control panel 20 is mounted to the front of the body 12 immediately underneath the cooktop 14. The lower control panel may include controls for the burners on the cooktop 14. The body 12 includes an internal oven cavity 22 with an access opening covered by an oven door 24 that is mounted to the body 12 immediately beneath the lower control panel 20.

FIG. 1 is broken open to diagrammatically illustrate the internal components of the present invention. The oven cavity 22 includes one or more bake burners at the lower portion of the oven cavity (not shown) and one or more broil burners 26 at the upper portion of the oven cavity 22. A gas mixing pipe 28 extends from the rear of the oven cavity and is in fluid communication with the broil burner 26 to receive air and gas for combustion. The gas mixing pipe 28 includes a flared end 30. The inlet of the gas mixing pipe 28 is outside the oven cavity and ambient air is drawn from around a rear portion of the range 10 for mixing with the gas from the nozzle 34.

A gas supply pipe 32 extends from a main gas supply through a distribution network (not shown) and, for purposes of the broil burner 26, includes a gas nozzle 34 to direct gas into the gas mixing pipe 28. Ambient air is drawn in with the gas from the nozzle 34 as primary air for combustion in the broil burner 26 to produce flame in order to elevate the temperature within the oven cavity 22 to cooking levels.

As the temperature in the oven cavity 22 increases to a predetermined level, typically, between 300° F. and 350° F., the heat from the top of the oven can cause problems with the cooktop 14 and the electric and electronic controls of the range. Therefore, an air channel 38 is located intermediate the oven cavity 22 and the cooktop 14. In order to more effectively cool the air between the cooktop 14 and the oven cavity 22, a fan 42 is mounted within a fan housing 40 adjacent a rear portion of the range 10 within the ventilation channel 38 to draw ambient air from outside the range 10 and direct such air through the ventilation channel 38 to cool the area between the cooktop 14 and the oven cavity 22. The airstream thusly created is illustrated generally by arrows in FIG. 1.

According to the preferred embodiment of the present invention, an air supply conduit in the form of a tube is illustrated at 52 and extends from the fan housing 40 where it receives air to the gas delivery pipe 32 where the air is discharged into the gas mixing pipe 28 to provide supplemental primary air, along with the gas from the gas nozzle 34 and the existing ambient primary air for combustion.

Figure 2:
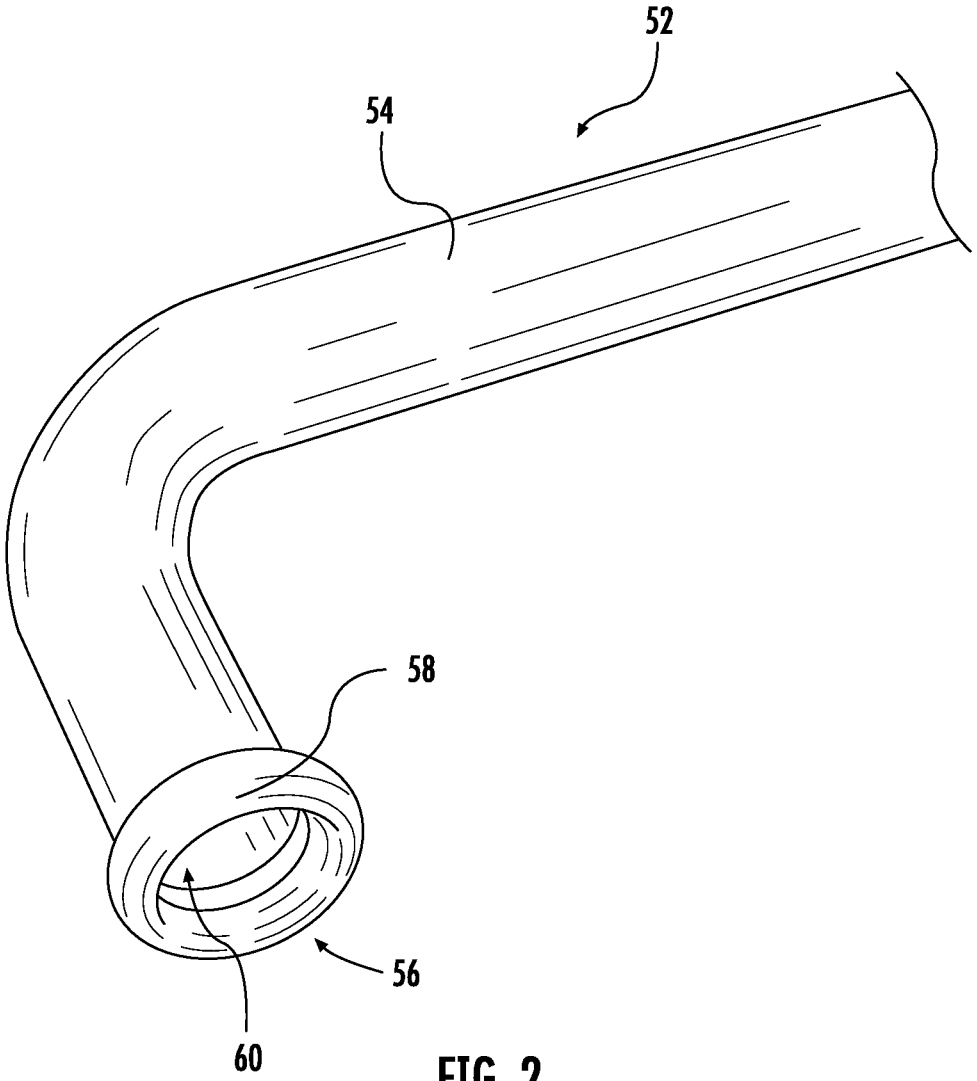
FIG. 2 is a partial view of the air conduit, illustrating the inlet, of the apparatus illustrated in FIG. 1.

As seen in FIG. 2, the air conduit 52 includes a generally tubular body 54 wherein the interior of the tubular body 54 defines an air channel 60. The tubular body 54 includes an inlet 56 to the air channel 60 with a flared end portion 58 for improved air intake.

Figure 3:
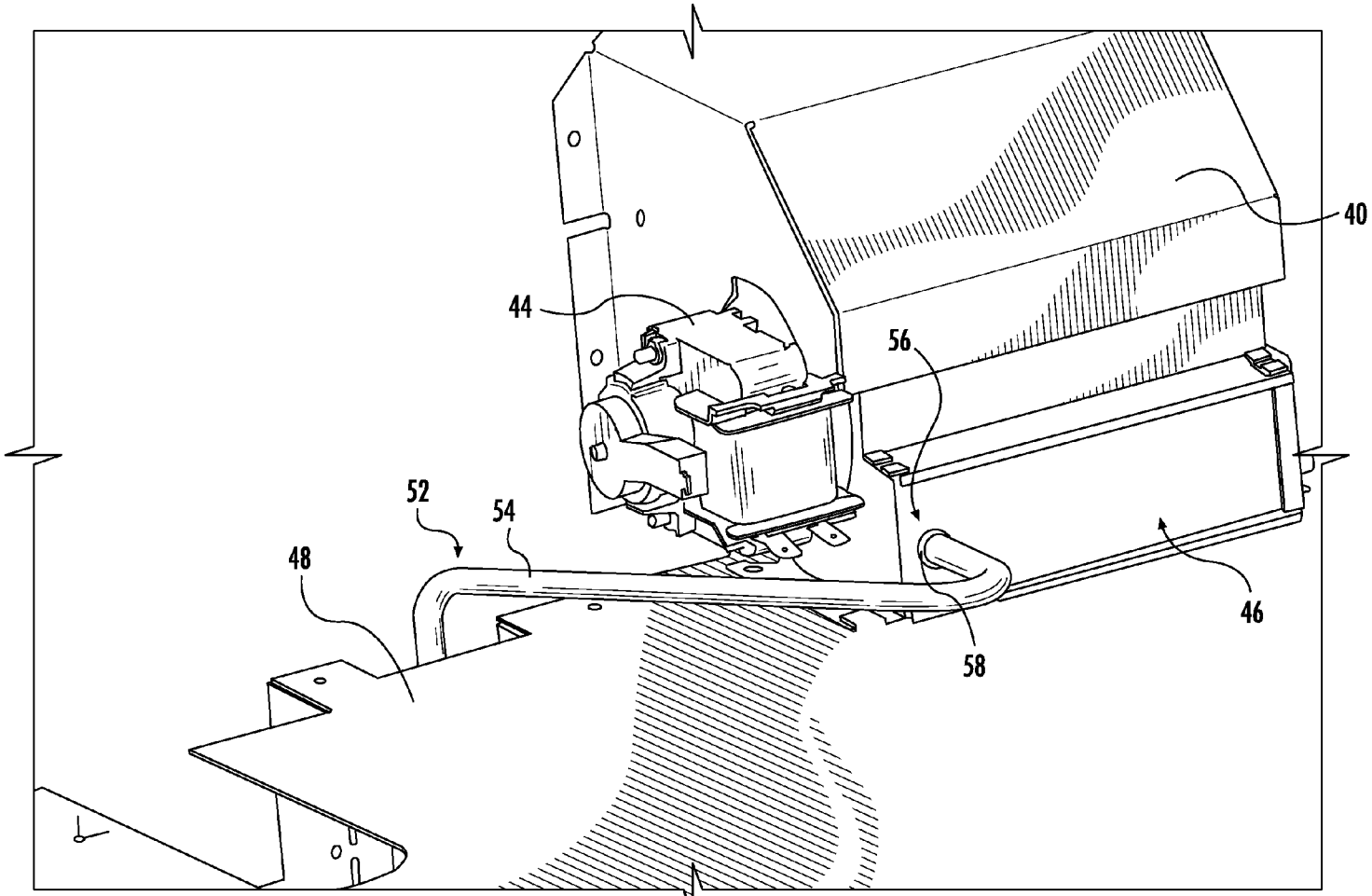
FIG. 3 is a front perspective view of the fan assembly and air conduit within the present home appliance.

Turning now to FIG. 3, the air conduit 52 is illustrated in relation to the fan housing 40 for directing air into the air conduit 52. There, the fan housing 40 is illustrated as a generally box-like structure having a fan motor 44 mounted on one side thereof, and which is in turn mounted to a horizontal support panel 48 within the range body 12. The fan blades (not shown) are of the centrifugal fan or squirrel cage fan type and are internal to the housing 40. The fan rotor extends the full width of the housing 40 and directs air into a plenum 46. It will be understood by those skilled in the art that the plenum 46 empties into the ventilation channel as illustrated in FIG. 1 which is not shown in FIG. 3 for clarity.

The air conduit 52 is mounted with its inlet 56 directed into the plenum 46 of the fan housing 40 to receive air from the fan. As noted above, the flared end portion 58 enhances the ability of the air conduit 52 to receive air. The air conduit 52 is bent at approximately a 45-degree angle to direct the air away from the fan housing 40 across the horizontal support panel 48 and downwardly toward the broil burner 26.

Figure 4:
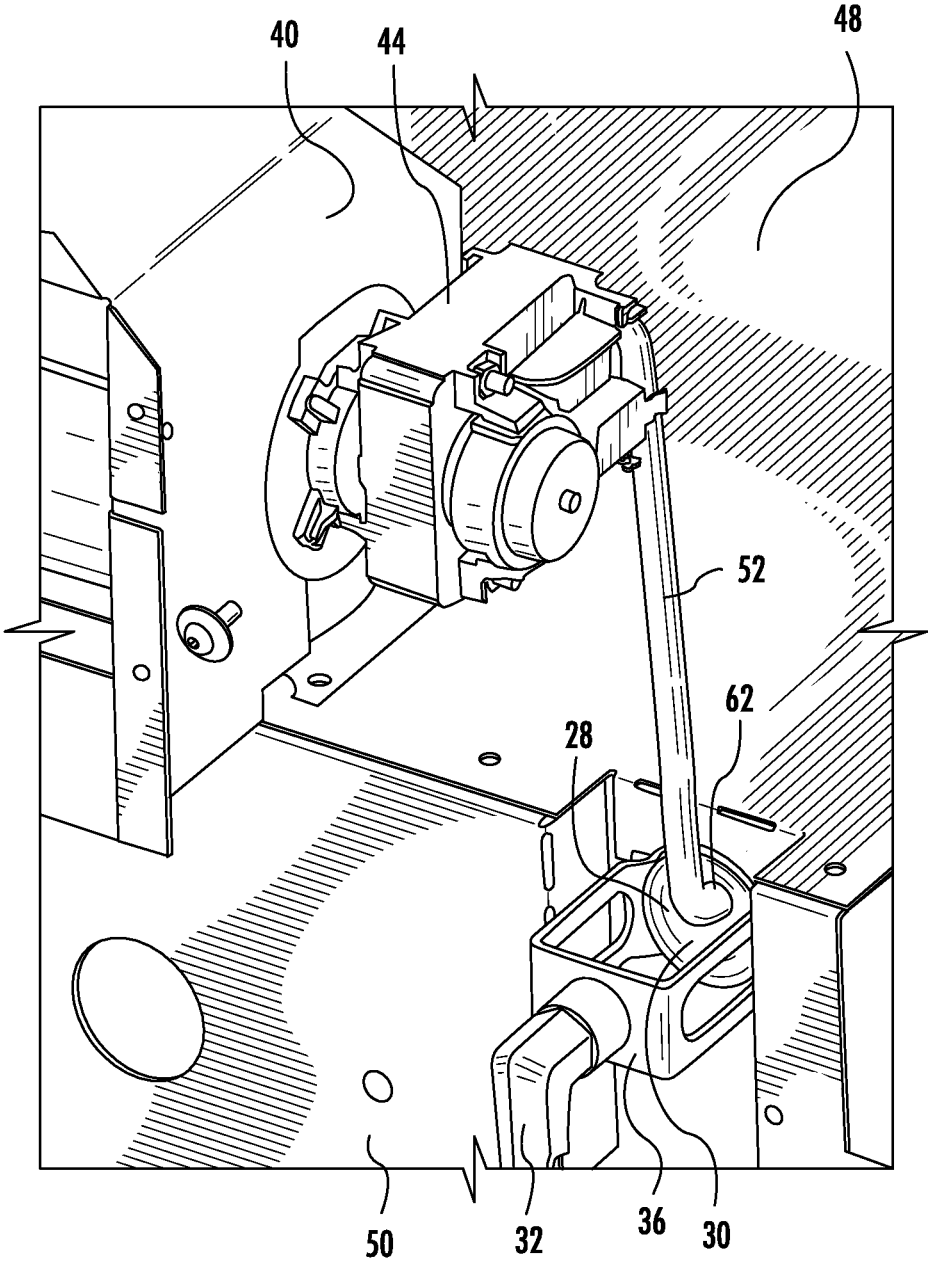
FIG. 4 is a rear view of the fan assembly and air conduit illustrated in FIG. 3.
Figure 5:
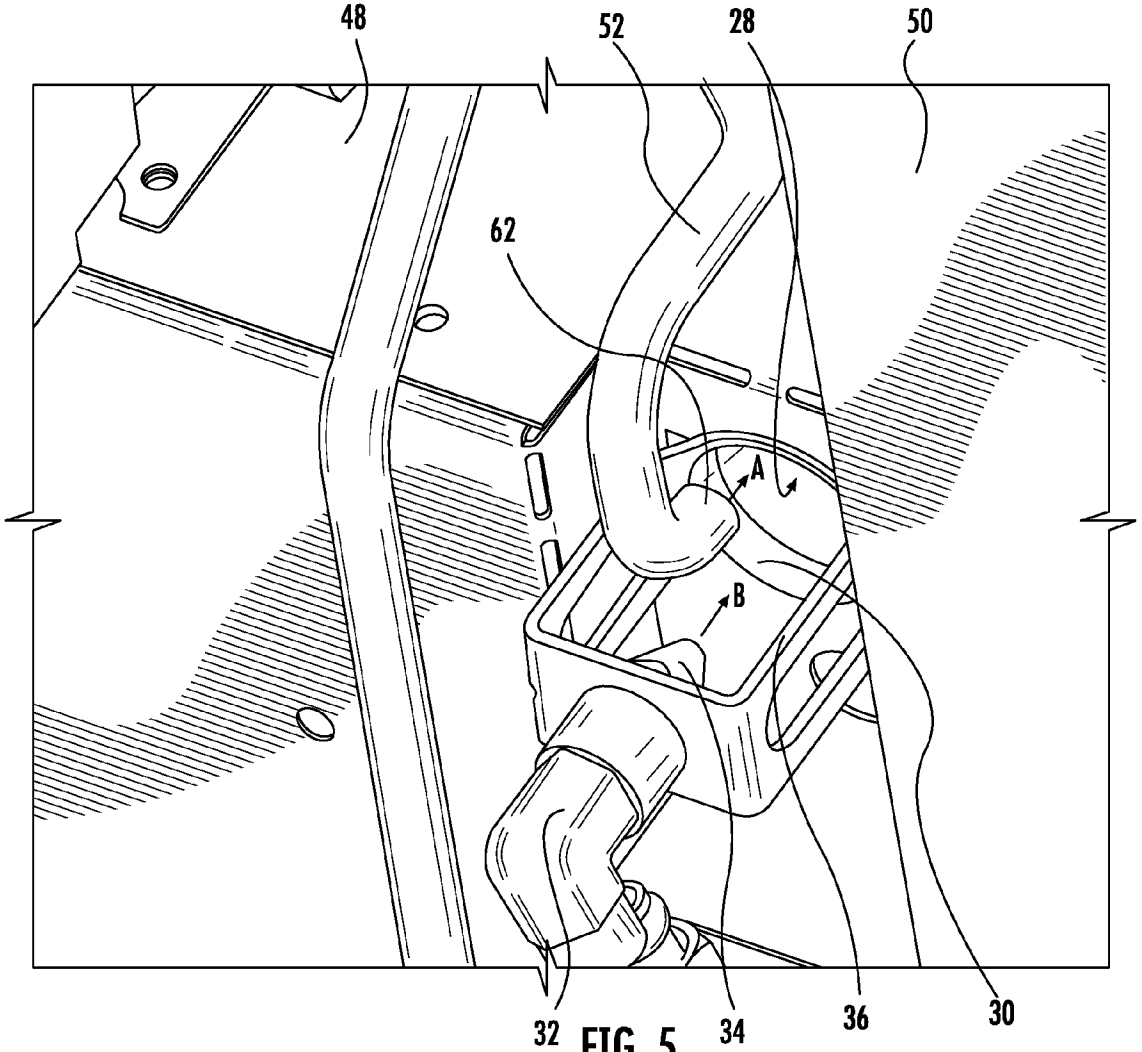
FIG. 5 is a perspective view of the gas and air delivery system illustrated in FIG. 4.

As seen in FIG. 4 and FIG. 5, the air conduit 52 smoothly bends through approximately 180° to direct air into the gas mixing pipe 28 for the broil burner 26. An extended bracket 36 is cantilevered away from a vertical support panel 50 to support a gas supply pipe 32 and direct an associated gas nozzle 34 at the inlet of the gas mixing pipe 28. The gas mixing pipe 28 includes a flared portion 30 to facilitate the inlet of air surrounding the gas mixing pipe 28 for combustion. The vertical support panel 50 resides internally of the range body panels. As seen in FIG. 5, gas from the gas nozzle 34 is illustrated by Arrow B while supplemental primary air from the air conduit 52 is illustrated at Arrow A. The outlet 62 of the air conduit 52 is placed closely adjacent the inlet to the gas mixing pipe 28 for maximum effect of the air injected by the air conduit 52.

In operation, as the oven temperature approaches about 300° F. to about 350° F., the fan motor 44 is activated to generate an air stream within the ventilation channel 38 as seen in FIG. 1. This air stream also directs air into the air conduit 52 which routes the air directly into the gas mixing pipe 28 as seen in FIG. 5 where the supplemental primary emitted from the air conduit 52 is mixed with gas and ambient air to enhance the combustion efficiency of the broil burner 26.

By the above, the present invention provides an inexpensive solution to enhancing the efficiency of the broil burner while utilizing existing parts of the range to minimize expense and lower manufacturing costs.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance comprising:

an appliance body;

a cooktop on the appliance body;

an oven cavity within the appliance body;

a gas-operable heating element within the oven cavity including a gas burner and a gas mixing pipe having an inlet outside of the oven cavity for intake of gas and primary ambient air for combustion;

a gas supply pipe for delivering gas to the gas mixing pipe for mixing with the primary ambient air;

a ventilation channel extending through the appliance body intermediate the cooktop and the oven cavity, the ventilation channel being open to atmosphere to draw air for ventilation from outside the appliance;

a ventilation fan in a fan housing within the appliance body, the ventilation fan being in fluid communication with the ventilation channel for creating a ventilation airstream within the ventilation channel wherein the fan is operatively associated with a trigger element that activates the fan responsive to a temperature within the oven cavity that exceeds a predetermined threshold level; and a supplemental primary air delivery system for use during ventilation fan operation including an air conduit extending between the fan housing and the gas mixing pipe to direct air to the gas mixing pipe for mixing with the primary ambient air and gas to form a combustible gas-air mixture.

2. A home appliance according to claim 1 wherein the fan housing includes an air outlet into the ventilation channel and the air conduit is mounted with the air conduit inlet in the air outlet of the fan housing.

3. A home appliance according to claim 1 wherein the air conduit is formed as a tubular member having an air channel extending between the air conduit inlet and the air conduit outlet for free air passage through the air conduit.

4. A home appliance according to claim 3 wherein the air conduit inlet includes a flared end portion.

5. A home appliance according to claim 3 wherein the air channel has a generally circular cross-section and a substantially constant diameter throughout its length.

6. A home appliance according to claim 1 wherein the air conduit outlet is mounted adjacent a gas supply nozzle at the inlet of the gas mixing pipe.

7. A home appliance according to claim 1 wherein the trigger element is a thermally controlled switch that activates the fan at a predetermined oven cavity temperature to provide air to the ventilation channel and the air conduit.

8. A home appliance according to claim 7 wherein the fan is configured to activate at a temperature in the range of about 300° F. to about 350° F.

9. A home appliance according to claim 1 wherein the fan includes an inlet for drawing air from outside the appliance for forced delivery of air to the ventilation channel and the air conduit.

10. A range comprising:

a range body;

a cooktop on the range body;

an oven cavity within the range body;

a gas-operable heating element within the oven cavity including a gas burner and a gas mixing pipe having an inlet outside of the oven cavity for intake of gas and primary ambient air for combustion;

a gas supply pipe for delivering gas to the gas mixing pipe for mixing with the primary ambient air;

a ventilation channel extending through the range body intermediate the cooktop and the oven cavity, the ventilation channel being open to atmosphere to draw air for ventilation from outside the range;

a ventilation fan in a fan housing within the range body, the ventilation fan being in fluid communication with the ventilation channel for creating a ventilation airstream within the ventilation channel wherein the fan is operatively associated with a trigger element that activates the fan responsive to a temperature within the oven cavity that exceeds a predetermined threshold level; and a supplemental primary air delivery system for use during ventilation fan operation including an air conduit extending between the fan housing and the gas mixing pipe to direct air to the gas mixing pipe for mixing with the primary ambient air and gas to form a combustible gas-air mixture.

11. A range according to claim 10 wherein the fan housing includes an air outlet into the ventilation channel and the air conduit is mounted with the air conduit inlet in the air outlet of the fan housing.

12. A range according to claim 10 wherein the air conduit is formed as a tubular member having an air channel extending between the air conduit inlet and the air conduit outlet for free air passage through the air conduit.

13. A range according to claim 12 wherein the air conduit inlet includes a flared end portion.

14. A range according to claim 12 wherein the air channel has a generally circular cross-section and a substantially constant diameter throughout its length.

15. A range according to claim 10 wherein the air conduit outlet is mounted adjacent a gas supply nozzle at the inlet of the gas mixing pipe.

16. A range according to claim 10 wherein the trigger element is a thermally controlled switch that activates the fan at a predetermined oven cavity temperature to provide air to the ventilation channel and the air conduit.

17. A range according to claim 16 wherein the fan is configured to activate at a temperature in the range of about 300° F. to about 350° F.

18. A range according to claim 10 wherein the fan includes an inlet for drawing air from outside the range for forced delivery of air to the ventilation channel and the air conduit.

19. A home appliance, comprising:

an appliance body;

a cooktop on the appliance body; and a ventilation channel positioned between the cooktop and an oven cavity, the ventilation channel including a fan in a fan housing at one end of the ventilation channel, wherein during operation the fan moves cooling air through the ventilation channel;

the oven cavity positioned within the appliance body, the oven cavity comprising:

a gas burner positioned at a top of the oven cavity below the ventilation channel;

a gas mixing pipe having an inlet outside of the oven cavity for receiving primary ambient air from the appliance body and gas via a nozzle of a gas supply pipe; and an air conduit positioned between the fan housing and the gas mixing pipe;

wherein supplemental primary air is supplied by the air conduit to the gas mixing pipe, such that the gas burner receives primary ambient air, gas, and supplemental primary air via the gas mixing pipe for combustion.

* * * * *